United States Patent [19]

Miller

[11] Patent Number: 4,603,605

[45] Date of Patent: Aug. 5, 1986

[54] THREAD VISE

[76] Inventor: Richard E. Miller, 17301 66th Ct., Tinley Park, Ill. 60477

[21] Appl. No.: 741,034

[22] Filed: Jun. 4, 1985

Related U.S. Application Data

[63] Continuation of Ser. No. 547,627, Nov. 1, 1983, abandoned.

[51] Int. Cl.[4] ..... B25B 13/50

[52] U.S. Cl. ..... 81/53.2

[58] Field of Search ..... 81/53.2, 65.2, 111

[56] References Cited

U.S. PATENT DOCUMENTS 2,746,328 5/1956 Valvano ..... 81/53.2
2,977,824 4/1961 Rueb ..... 81/111 X
3,008,363 11/1961 Cook ..... 81/185 X
3,094,022 6/1963 Young ..... 81/53.2

*Primary Examiner*—James G. Smith
*Attorney, Agent, or Firm*—Hill, Van Santen, Steadman & Simpson

[57] ABSTRACT

A unitary, one-piece device for gripping threaded objects without damage to the threads. The device can be utilized for a number of functions including grippingly engaging and securing a threaded member for performing various operations on it. The device is also adaptable for use as a thread chaser to clean and/or rehabilitate damaged threads on a bolt or stud. Additionally, the device of the present invention is utilizable as a stud remover.

7 Claims, 6 Drawing Figures

THREAD VISE

This is a continuation, of application Ser. No. 547,627, filed Nov. 1, 1983 now abandoned.

BACKGROUND OF THE INVENTION

In the past, numerous methods and devices have been used to securely hold a threaded object such as a bolt, stud, or threaded rod when the object is to be worked on for any of a number of reasons. One approach has been to insert wooden boards along the sides of a vise and then clamp the threaded object between the boards to prevent damage to the threads. This arrangement has been cumbersome, has not always prevented damage to the threads, and has not been susceptible of applying sufficient force to the threaded object under all circumstances.

Another approach common in the art of stud removal has been to double nut a threaded object to turn it. One nut of suitable size is run onto the threaded object, and a second nut is run up against the first. The second nut is tightened against the first nut, thus binding the two nuts on the threaded object for the purpose of rotating the threaded member by applying force to one nut or the other depending on the direction of rotation desired. This arrangement also has met with difficulties in that it applies a great amount of stress on the threads and often results in one of the two nuts becoming loosened and defeating the purpose of the arrangement.

Certain other approaches have been used in connection with devices in this general field. Valvano Pat. Nos. 2,571,968 and 2,681,582 disclose multi-piece arrangements for securing a threaded member. The '968 patent includes a threaded bore and a wedge-shaped locking member, and the '582 patent discloses a two-piece arrangement including a pair of jaws which are biased apart from each other, but which may be closed to apply pressure to the threaded object. These devices may be operable for insertion of studs or removal of studs which are clean, but cannot provide sufficient gripping pressure for removal of studs which have rusted in place.

Typical of prior art die cutting arrangements are the devices shown in U.S. Pat. Nos. 451,890, 1,048,921, 1,416,059, and 2,054,745. Campaigne U.S. Pat. No. 1,857,493 shows a thread-chasing device including opposed clamp blocks with a polygonal opening and a cutting member designed to engage the angle of the threads to be operated on. U.S. Pat. No. 1,897,666 deals with a multi-part machine tool spindle. U.S. Pat. No. 3,094,022 discloses a threaded stud extractor tool utilizing rows of circumferentially spaced, longitudinally spaced set screws for engaging a stud and applies torque thereto.

It will be seen that the prior art discussed comprises relatively complex and expensive arrangements which are capable of exerting only limited gripping force as opposed to the unitary, one-piece, simple design of the invention herein which is capable of applying substantial gripping force when required.

SUMMARY OF THE INVENTION

The present invention is a multi-purpose device designed to grippingly engage a threaded member and adapted to perform a variety of functions including securement of the threaded member while other operations are performed thereon, chasing or cleaning of the threaded surface, and removal of studs. It is an improvement over the prior art devices in that it is simple to use and economical to manufacture. The base member is a unitary, one-piece, gripping collet which can be acted upon by a gripping pliers or other force-applying mechanism to engage a threaded member and secure the same against relative rotation while preventing damage to the threaded surface. A modified embodiment is described which includes its own force-applying mechanism causing the unitary arrangement to grippingly engage the threaded surface.

DESCRIPTION OF THE PREFERRED EMBODIMENT

Figure 1:
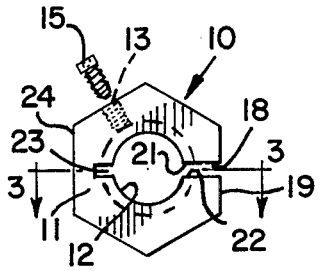
FIG. 1 is a top view of one embodiment of the present invention.
Figure 2:
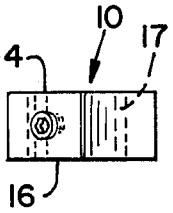
FIG. 2 is a rear view of the embodiment of FIG. 1.
Figure 3:
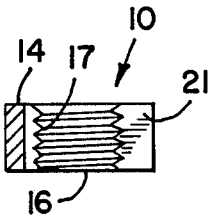
FIG. 3 is a sectional view taken along the lines 3—3 of FIG. 1.

In FIGS. 1 through 3 is illustrated one embodiment of the present invention. FIG. 1 shows a thread-gripping device 10 comprising a base member or sleeve 11 which is illustrated in the form of a hexagonal-headed split nut. The base member 11 includes a threaded opening 12 extending through the base member from upper surface 14 to lower surface 16. A threaded aperture 13 is provided in the side wall of the base member 11 extending entirely through the wall of the base member and intersecting the threaded opening 12. A set screw 15 is shown in FIG. 1 adapted to be inserted in the aperture 13, if needed, as will be described later. The set screw 15 preferably is of the "Allen-head" type having an internally disposed polygonal socket at one end for engagement by an Allen wrench for tightening of the screw. Preferably, the set screw 15 is of a length such that when fully inserted in its operative position, its outer end will not protrude beyond the side wall of the base member so as to enable a socket or other type of wrench to be positioned overlying the base member.

In FIG. 2 threads 17 are illustrated as extending the entire length of the opening 12, but this is not always necessarily the case since, depending upon the overall thickness of the base member 11, the threads may extend for only a portion of the thickness. A first slot 18 is defined in the base member 11 extending its entire thickness from upper surface 14 through lower surface 16. The first slot 18 may be milled or cut into the base member and extends from the opening 12 to outer wall 19. The width of the slot 18 will vary depending upon the size of the bolt or thread which the gripping device is designed to engage. The width of the slot will increase as the overall dimensions of the gripping device increase. The purpose of the first slot 18 is to allow compression of the gripping device when force is exerted from the outside of the base member, thereby reducing the dimension of the gap formed between opposed side walls 21 and 22.

A second slot 23 is defined in the base member and extends from the opening 12 toward outer wall 24, but stops short thereof. The length of the slot 23 will also vary depending upon the overall dimension of the threaded object to be gripped, and, accordingly, the dimensions of the base member 11. In one actual embodiment, applicant formed a base member adapted to be used on a standard, coarse thread half-inch bolt. The base member was made from a standard, one-half inch, coarse thread nut with a slot width of approximately one-eighth inch for both slots. The material from which the base member is formed is not deemed to be of critical importance, but it is preferable to have the base member formed of a metal which is harder than the metal of the threaded member to be gripped.

It has been found advantageous, in the embodiment shown in FIGS. 1–3, to form the slot 23 having a length approximately equal to one half the distance from the perimeter of the opening 12 to the outer wall 24. The function of the second slot 23 is to increase the ability of the gripping device to contract when pressure is exerted on the device and to more easily allow the device to securely grip the threaded member.

The operation of the embodiment shown in FIGS. 1 through 3 is as follows. If the device is to be utilized for stud removal, the base member 11 is loosely threaded over the exposed end of the stud to be removed. It should be apparent at this point that various sizes and thread patterns of the device should be available to accommodate the various sizes and threading profiles of threaded members to be encountered in a given job. Each of the devices can be marked so as to indicate the size and thread which it will accommodate.

Once the appropriate device is selected to mate with the particular threaded member to be removed, pressure is then applied on the exterior of the base member by any of a number of conventional methods including, for example, a VISE GRIP locking pliers or a CHANNEL LOCK device. The gripping device is squeezed causing the gap between the opposed wall faces 21 and 22 to narrow, allowing the threads 17 of the gripping device to firmly engage the threads of the stud to be removed. If the stud appears to be rusted and it is determined that more than normal force will be required for stud removal, the set screw 15 can be utilized. With the screw 15 removed from the aperture 13, a drill bit of smaller size than the aperture is inserted through it and the drill actuated so as to engage the stud. Pressure is applied sufficient to create a pocket in the periphery of the stud so as to receive the set screw 15. The set screw is then inserted into the aperture and tightened by an Allen wrench until the set screw is firmly seated in the pocket formed in the stud.

Once this has been accomplished, the gripping device, now secured against relative rotation on the threaded stud is turned in a direction to cause the stud to rotate out of its threaded engagement. Once the stud has been removed, the pressure on the gripping device is released, the set screw is removed, and the base member is easily removed from the stud without having caused any damage to the threads of the stud which was removed.

Figure 4:
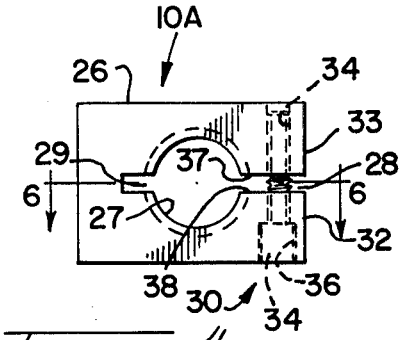
FIG. 4 is a top view of a modified embodiment of the present invention.
Figure 5:
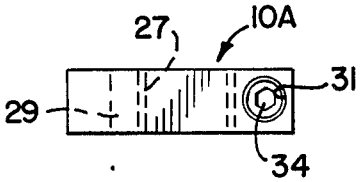
FIG. 5 is a front view of the embodiment illustrated in FIG. 4.
Figure 6:
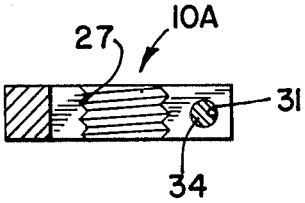
FIG. 6 is a sectional view taken along the lines 6—6 of FIG. 4.

A modified and alternative embodiment of the present invention is shown in FIGS. 4 through 6. A gripping device 10*a* is illustrated in FIG. 4 which, like the embodiment of FIG. 1, includes a base member 26, a threaded opening 27, a first slot 28, and a second slot 29. No set screw arrangement is shown in this embodiment since it is not usually required due to the greater gripping ability of this embodiment. It would be considered, however, within the scope of the invention to modify this embodiment to include the set screw arrangement 13, 15 of FIGS. 1–3.

The embodiment of FIGS. 4 through 6 includes its own force-applying means 30 as an integral component of the device. The force-applying means 30 includes an opening 31 disposed in the base member 26 at one end thereof lying in a direction generally perpendicular to the central axis of the opening 27 and extending through a first leg 32 and a second leg 33, which both extend from the base member 26 and which are separated by the slot 28. FIGS. 4 through 6 illustrate the opening 31 as being a threaded aperture adapted to receive a fastening member 34 illustrated as being an allen-head cap screw.

A recess 36 is formed in the leg 32 to receive the head of the screw 34. It can be readily seen that upon rotation of the screw 34 in a clockwise direction, the gap defined by slot 28 between opposed side faces 37 and 38 can be narrowed to cause gripping engagement of the internal threads of the gripping device 26 over the threads of a stud or bolt.

The embodiment shown in FIGS. 4 through 6 illustrates the force-applying means 30 as consisting of an allen-head cap screw which is received in a threaded bore in the leg 33, but any of a number of conventional force-applying means could be used to achieve the same result. For example, but not by way of limitation, an untapped hole could be drilled entirely through legs 32 and 33 and a bolt could extend through both legs receiving a nut and washer arrangement on the outside surface of one of the legs. Force could then be applied by rotating the bolt while holding the nut in a fixed position.

Various features of the invention have been particularly shown and described in connection with the illustrated embodiments of the invention, however, it must be understood that these particular arrangements merely illustrate and that the invention is to be given its fullest interpretation within the terms of the appended claims.

What is claimed is:

1. A wrench receiving thread cleaning and gripping device adapted to be threaded on and advanced the full exposed length of an externally threaded stud to clean the stud threads and to position the nut at a desired level of the stud which comprises a one piece radially split nut having opposed external sides adapted to receive the jaws of a wrench in non-rotating relation and an internally threaded open ended bore therethrough having threads mating with the threads of the stud to be cleaned and gripped, the split ends of said nut being spaced apart to define a gap therebetween, an internal longitudinal groove through said bore diametrically opposite the gap providing a reduced thickness bending zone accommodating contraction of the nut around the stud to lock the mating threads of the nut and stud against relatiye rotation, and means for reducing the gap between the split ends of the nut and bending the reduced thickness bending zone to contract the bore of the nut forcing the internal threads into firm mated locked engagement with the threads of the stud without damaging the stud threads when wrench torque is applied to the nut in either clockwise or counterclockwise directions.

2. The device of claim 1 wherein the nut has a threaded hole radially therethrough in circumferentially spaced relation from the gap and groove, and a set screw is threaded in said hole with an inner end blocking the internal threads of the bore to further lock the stud against rotation relative to the nut.

3. The device of claim 1 wherein the nut is composed of metal harder than the stud.

4. The device of claim 2 wherein the set screw has a wrench receiving socket head, a length submerging the head in the hole when the set screw is tightened, and the set screw is adapted to be removed from the hole to accommodate insertion of a drill through the hole for sinking a recess in the stud adapted to receive the set screw to further lock the stud against rotation relative to the nut.

5. The device of claim 1 wherein the means for contracting the nut is a draw bolt extending through the nut and across the gap thereof.

6. The device of claim 5 wherein the nut has a threaded hole on one side of the gap and an aligned unthreaded hole on the opposite side of the gap, and the draw bolt has a shank threaded into the threaded hole and a head submerged in the unthreaded hole.

7. The device of claim 1 wherein the wrench receiving opposed sides of the nut are flat and lie on opposite sides of the gap.

* * * * *